US008631980B2

(12) United States Patent
Youssefi-Shams et al.

(10) Patent No.: US 8,631,980 B2
(45) Date of Patent: Jan. 21, 2014

(54) APPARATUS FOR SUPPORTING HANDHELD ELECTRONIC DEVICE

(75) Inventors: Kasra Youssefi-Shams, Waterloo (CA); Felipe Oliveira Simoes, Kitchener (CA); Michael Xingyi Yu, Waterloo (CA)

(73) Assignee: BlackBerry Limited, Waterloo (CA)

( * ) Notice: Subject to any disclaimer, the term of this patent is extended or adjusted under 35 U.S.C. 154(b) by 969 days.

(21) Appl. No.: 12/464,635

(22) Filed: May 12, 2009

(65) Prior Publication Data

US 2010/0288804 A1 Nov. 18, 2010

(51) Int. Cl.
*A45F 3/00* (2006.01)
*A45F 5/00* (2006.01)
*A45C 1/04* (2006.01)

(52) U.S. Cl.
USPC ..... 224/197; 224/617; 224/666; 224/668; 224/269

(58) Field of Classification Search
USPC ..... 224/197, 617, 618, 621, 666, 668, 268, 224/269
See application file for complete search history.

(56) References Cited

U.S. PATENT DOCUMENTS 4,172,543 A * 10/1979 Fischer ..... 224/268
4,504,001 A * 3/1985 Nichols ..... 224/198
4,504,101 A * 3/1985 Reimer ..... 439/59
5,564,610 A * 10/1996 Barron ..... 224/268
5,620,120 A * 4/1997 Tien ..... 224/199
5,806,146 A * 9/1998 Chen ..... 24/3.11
5,850,954 A * 12/1998 Dong-Joo ..... 224/197
6,073,318 A 6/2000 Phillips
6,161,741 A * 12/2000 French ..... 224/198
6,205,222 B1 3/2001 Carpenter (Continued)

FOREIGN PATENT DOCUMENTS

CA 2378553 A1 3/2010

OTHER PUBLICATIONS

International Search Report from corresponding PCT International Application No. PCT/CA2009/000660 dated Feb. 11, 2010.

(Continued)

*Primary Examiner* — Nathan J Newhouse
*Assistant Examiner* — Lester L Vanterpool
(74) *Attorney, Agent, or Firm* — Norton Rose Fulbright Canada LLP

(57) ABSTRACT

There is provided an apparatus for supporting a handheld electronic device including a holster and a clip. The holster defines a pocket for receiving a handheld electronic device and supporting the received handheld electronic device. The clip is coupled to the holster and is configured for movement between an open position and a gripping position and is biased towards the gripping position. In the open position, spacing is provided between the clip and the holster so as to receive an article. In the gripping position, the clip is disposed such that, when an article is disposed between the clip and the holster, the article is gripped by the clip against at least one gripping surface portion of the holster under the force effecting biasing of the clip towards the gripping position. When the clip is disposed in the gripping position, and a handheld electronic device is received and supported by the pocket, coupling of the handheld electronic device to the article is thereby effected. When the coupling of the handheld electronic device to the article is effected, the minimum distance between the handheld electronic device each one of the at least one gripping portion of the holster is at least eighteen (18) millimetres.

20 Claims, 15 Drawing Sheets

(56) References Cited

U.S. PATENT DOCUMENTS

| | | | | |
|---|---|---|---|---|
| 6,283,348 | B1 * | 9/2001 | Wang | 224/271 |
| D457,308 | S * | 5/2002 | Infanti | D3/218 |
| 6,405,910 | B1 | 6/2002 | Infanti et al. | |
| 6,685,067 | B2 * | 2/2004 | French | 224/198 |
| 6,752,299 | B2 * | 6/2004 | Shetler et al. | 224/197 |
| 6,889,878 | B2 * | 5/2005 | Parsons | 224/200 |
| 6,955,279 | B1 * | 10/2005 | Mudd et al. | 224/197 |
| 6,993,370 | B2 * | 1/2006 | Chen | 455/575.1 |
| 7,458,489 | B1 * | 12/2008 | Mudd et al. | 224/197 |
| 7,478,776 | B2 * | 1/2009 | Salentine et al. | 242/379 |
| 8,333,310 | B2 * | 12/2012 | Tages | 224/197 |
| 2002/0139822 | A1 | 10/2002 | Infanti | |
| 2004/0226836 | A1 | 11/2004 | Schreiber et al. | |
| 2006/0196902 | A1 * | 9/2006 | Chen et al. | 224/197 |
| 2008/0012706 | A1 | 1/2008 | Mak-Fan et al. | |
| 2008/0110946 | A1 | 5/2008 | Dixon et al. | |

OTHER PUBLICATIONS

Written Opinion of the International Searching Authority from corresponding PCT International Application No. PCT/CA2009/000660 dated Feb. 11, 2010.

Canadian Intellectual Property Office, Office Action Dated Apr. 12, 2012, issued on Canadian Patent Application No. 2,761,565.

* cited by examiner

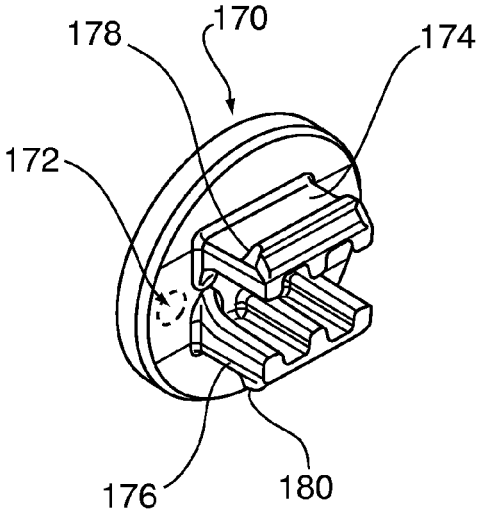
Fig.11
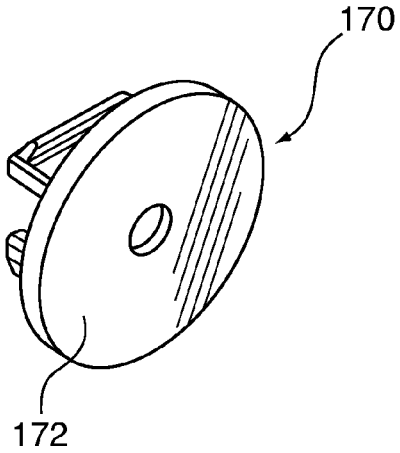
Fig.12
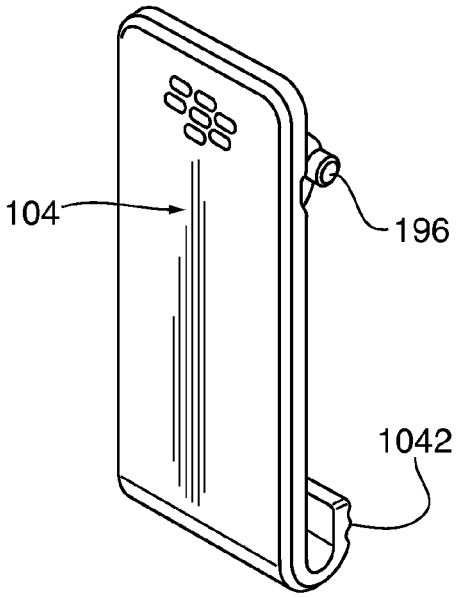
Fig.15
Fig.13
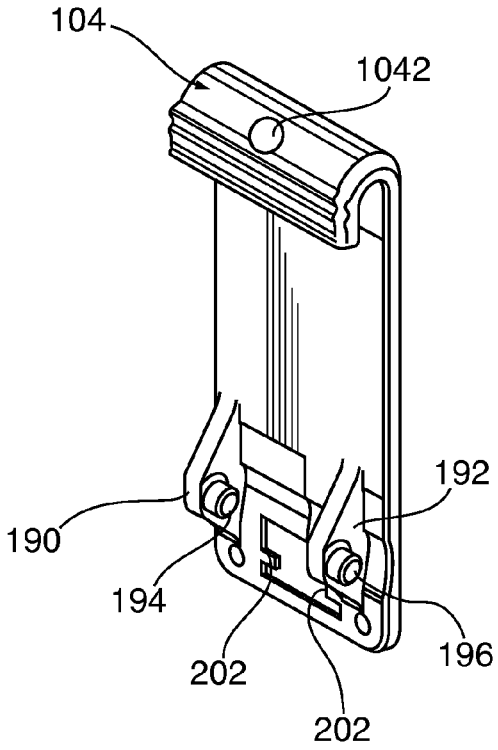

APPARATUS FOR SUPPORTING HANDHELD ELECTRONIC DEVICE

TECHNICAL FIELD

This relates to the field of devices for supporting portable handheld electronic devices.

BACKGROUND OF THE ART

A standard carrying case or pouch generally includes a clip. Such a clip can attach the case to such things as a belt or over the waistline of clothes. Mobile handhelds are carried in cases having such a clip. The clip is used to attach the case to the user's belt or over the waistline of their clothes, as examples, to make carrying easier.

It is sometimes desirable that the handheld device be sufficiently spaced from the person to whom the mobile handheld is attached.

BRIEF DESCRIPTION OF THE DRAWINGS

FIG. 11 is a perspective view of one side of the retainer of the embodiment illustrated in FIG. 1.

FIG. 12 is a perspective view of another side of the retainer illustrated in FIG. 11;

FIG. 13 is a perspective view of one side of the clip of the embodiment illustrated in FIG. 1.

FIG. 15 is a perspective view of another side of the clip illustrated in FIG. 13;

DETAILED DESCRIPTION OF PREFERRED EMBODIMENTS

Figure 2:
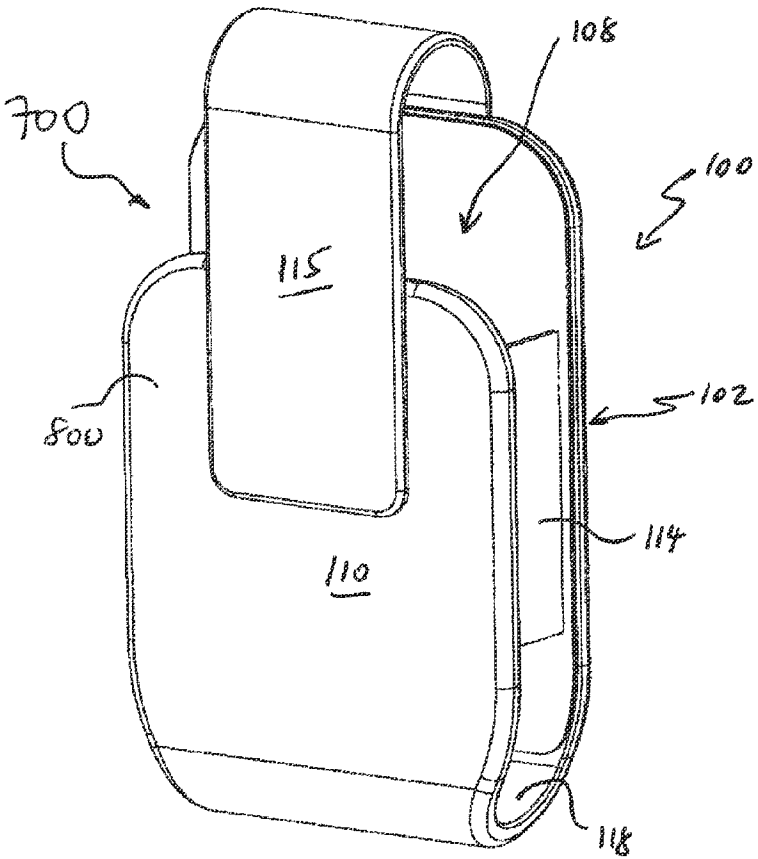
FIG. 2 is a front perspective view of the embodiment of the apparatus illustrated in FIG. 1.

In one aspect, there is provided an apparatus for supporting a handheld electronic device including a holster and a clip. The holster includes a pocket for receiving a handheld electronic device and supporting the received handheld electronic device. The clip is coupled to the holster and is configured for movement between an open position and a gripping position and is biased towards the gripping position. In the open position, spacing is provided between the clip and the holster so as to receive an article. In the gripping position, the clip is disposed such that, when an article is disposed between the clip and the holster, the article is gripped by the clip against at least one gripping surface portion of the holster under the force effecting biasing of the clip towards the gripping position. When the clip is disposed in the gripping position, and a handheld electronic device is received and supported by the pocket, coupling of the handheld electronic device to the article is thereby effected. When the coupling of the handheld electronic device to the article is effected, the minimum distance between the handheld electronic device each one of the at least one gripping portion of the holster is at least eighteen (18) millimetres.

In another aspect, there is provided an apparatus for supporting a handheld electronic device, comprising a holster and a clip. The holster includes a pocket for receiving a handheld electronic device and supporting the received handheld electronic device. The clip is coupled to the holster and configured for movement between an open position and a gripping position and being biased towards the gripping position, wherein, in the open position, spacing is provided between the clip and the holster so as to receive an article, and wherein, in the gripping position, the clip is disposed such that, when an article is disposed between the clip and the holster, the article is gripped by the clip against at least one gripping surface portion of the holster under the force effecting biasing of the clip towards the gripping position, and such that, when the clip is disposed in the gripping position, and a handheld electronic device is received and supported by the pocket, coupling of the handheld electronic device to the article is thereby effected. The holster further includes an operative interior holster surface fraction consisting of at least one operative interior holster surface portion which is configured to oppose and at least contribute support to a handheld electronic device when the handheld electronic device is received and supported within the pocket. When the clip member is disposed in the gripping position, each one of the at least one operative interior holster surface portion is spaced apart from each one of the at least one gripping portion of the holster by a respective minimum distance of at least eighteen (18) millimetres.

In a further aspect there is provided a method of manufacturing an apparatus for supporting a handheld electronic device. The method includes providing a holster preform, providing a clip, providing a stationary clip effecting integrator and a positionable clip effecting integrator, wherein, when provision of a holster is effected by coupling of the stationary clip effecting integrator to the holster preform and when the stationary clip effecting integrator is also coupled to the clip, a stationary clip is provided which is disposed in a stationary condition relative to the holster, and wherein, when provision of a holster is effected by coupling of the positionable clip effecting integrator to the holster preform and when the positionable clip effecting integrator is also coupled to the clip, a positionable clip is provided which is disposed in a positionable condition relative to the holster, and selecting one of the integrators. Formation of the apparatus is then effected, wherein the apparatus includes a holster coupled to the clip, wherein the holster includes the holster preform and the selected integrator, wherein the holster preform is coupled to the selected integrator, and wherein the selected integrator is coupled to the clip.

In yet a further aspect, there is provided an apparatus for supporting a handheld electronic device comprising a holster and a clip. The holster includes a pocket for receiving a handheld electronic device and supporting the received handheld electronic device. Further, the holster includes a stationary clip effecting integrator, and a clip mounting structure. The clip mounting structure is coupled to the stationary clip effecting integrator by a force effecting press-fit engagement of the clip mounting structure to the stationary clip effecting integrator. The clip is coupled to the clip mounting structure and configured for movement between an open position and a gripping position and being biased towards the gripping position, wherein, in the open position, spacing is provided between the clip and the holster so as to receive an article, and wherein, in the gripping position, the clip is disposed such that, when an article is disposed between the clip and the holster, the article is gripped by the clip against at least one gripping surface portion of the holster under the force effecting biasing of the clip towards the gripping position, and such that, when the clip is disposed in the gripping position, and a handheld electronic device is received and supported by the pocket, coupling of the handheld electronic device to the article is thereby effected. The stationary clip effecting integrator includes an interference structure which interferes with movement of the clip mounting structure in response to a force applied to the clip mounting structure for urging rotation of the clip mounting structure in a plane which is orthogonal to the direction of the force which is effecting the press-fit engagement of the clip mounting structure to the stationary clip effecting integrator.

Referring to FIGS. 1, 2, 5, 6A, and 6B, there is provided an apparatus 100 for supporting a handheld electronic device 500. The apparatus 100 includes a holster 102 and a clip 104. The holster 102 includes a pocket 108 for receiving the handheld electronic device 500 and supporting the received handheld electronic device 500. The clip 104 is coupled to the holster 102 and configured for movement between an open position and a gripping position, and is biased towards the gripping position. For example, in some embodiments, the coupling is a pivotal coupling. In the open position, spacing is provided between the clip 104 and the holster 102 so as to receive an article 600 (such as an article of clothing 600), and wherein, in the gripping position, the clip 104 is disposed such that, when an article 600 is disposed between the clip 104 and the holster 102, the article 600 is gripped by the clip 104 against at least one gripping surface portion 20 of the holster 102 under the force effecting biasing of the clip 104 towards the gripping position. In this respect, when the clip 104 is disposed in the gripping position, and a handheld electronic device 500 is received and supported by the pocket 108, coupling of the handheld electronic device 500 to the article of clothing 600 is thereby effected. Prior to the article 600 being gripped, the article of clothing 600 has been previously received within the spacing provided between the clip 104 and the holster 102 when the clip 104 is disposed in the open position. In order to effect gripping of an article 600 received within the above-described spacing, the clip 104 is urged into the gripping position by the force effecting biasing of the clip 104 towards the gripping position.

In some embodiments, a biasing member 106 is provided for urging or biasing the clip 104 to the gripping position. For example, the biasing member 106 is a resilient member. For example, a suitable resilient member is a spring, such as a leaf spring.

In some embodiments, the clip 104 is sufficiently resilient such that, when a manual force has been applied to effect movement of the clip 104 from the gripping position to the open position, the clip 104 returns to the gripping position when the manual force is removed.

In some embodiments, the handheld electronic device 500 is a BlackBerry Bold™ (BlackBerry 9000™) manufactured by Research In Motion Limited. Other examples of suitable handheld electronic devices include cellular phones, mobile handhelds, digital wireless phones, 1-way pagers, 1½-way pagers, 2-way pagers, electronic mail appliances, internet appliances, personal digital assistants (PDA), laptop computers, portable digital audio players, and the like.

In some embodiments, the holster 102 includes a front wall portion 110, a rear wall portion 112, side wall portions 114, 116, and a floor 118, which co-operate to define a pocket 108. In this respect, the clip 104 is pivotally coupled to the rear wall portion 112.

In some embodiments, there is provided a strap 115 which is attached to an exterior surface of the rear wall portion 112 and extends into a space disposed above the pocket 108 and is configured for releasable coupling to an exterior surface of the front wall portion 110. For example, the releasable coupling is effected by interaction of hook and loop type material such as Velcro™. Alternatively, the strap 115 includes a magnet and the front wall portion 110 includes a magnet, and the strap 115 is urged towards coupling with the front wall portion 110 when the magnet of the strap 115 becomes disposed in sufficiently close proximity to the magent of the front wall portion 110 such that the magnetic fields of each of the magnets interact to effect an operative attractive force between them.

Figure 1:
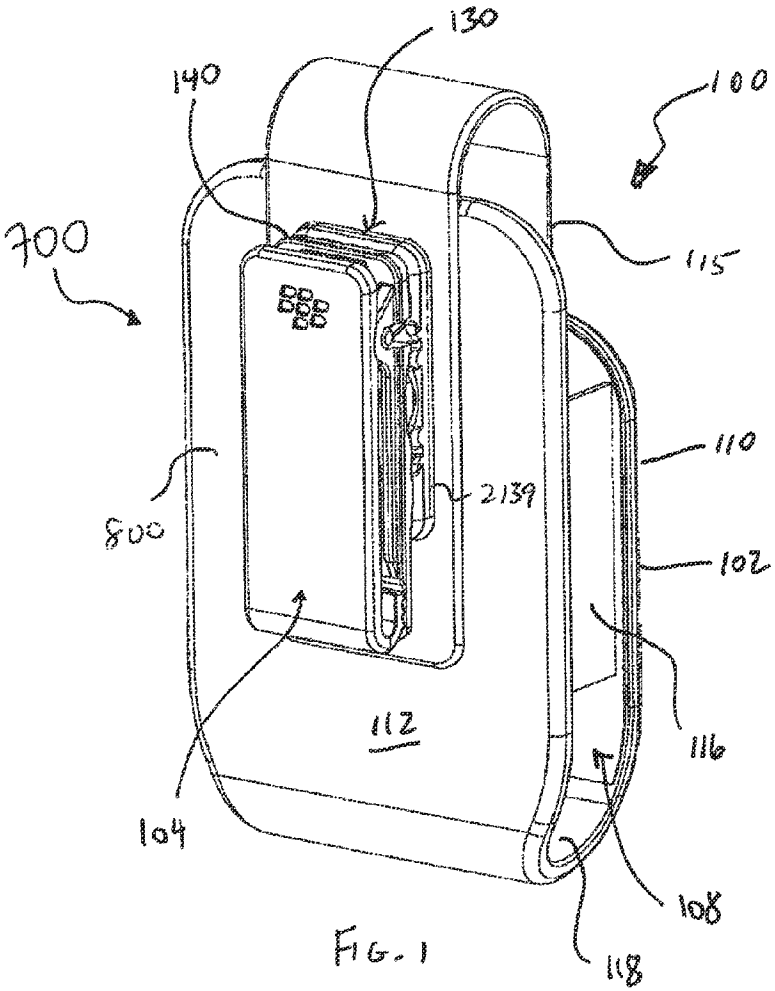
FIG. 1 is a rear perspective view of an embodiment of an apparatus.
Figure 4:
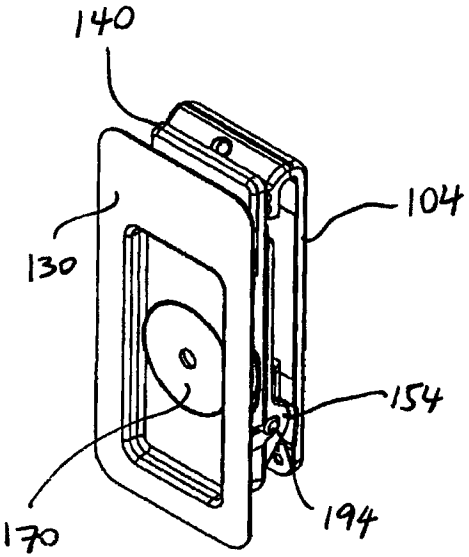
FIG. 4 is a front perspective view of the clip, the clip mounting structure, and the positionable clip effecting integrator of the embodiment illustrated in FIG. 1.
Figure 3:
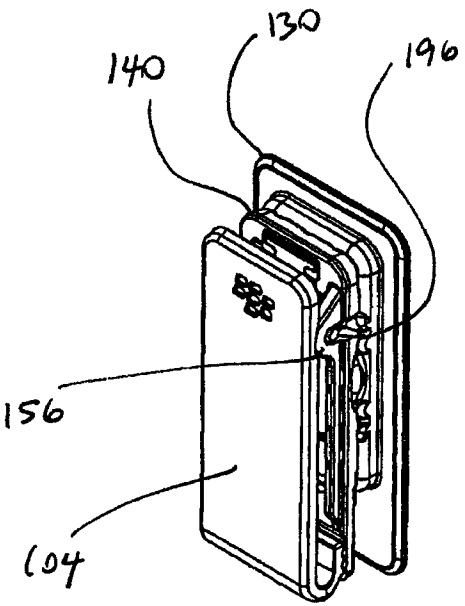
FIG. 3 is a rear perspective view of the clip, the clip mounting structure, and the positionable clip effecting integrator of the embodiment illustrated in FIG. 1.
Figure 7:
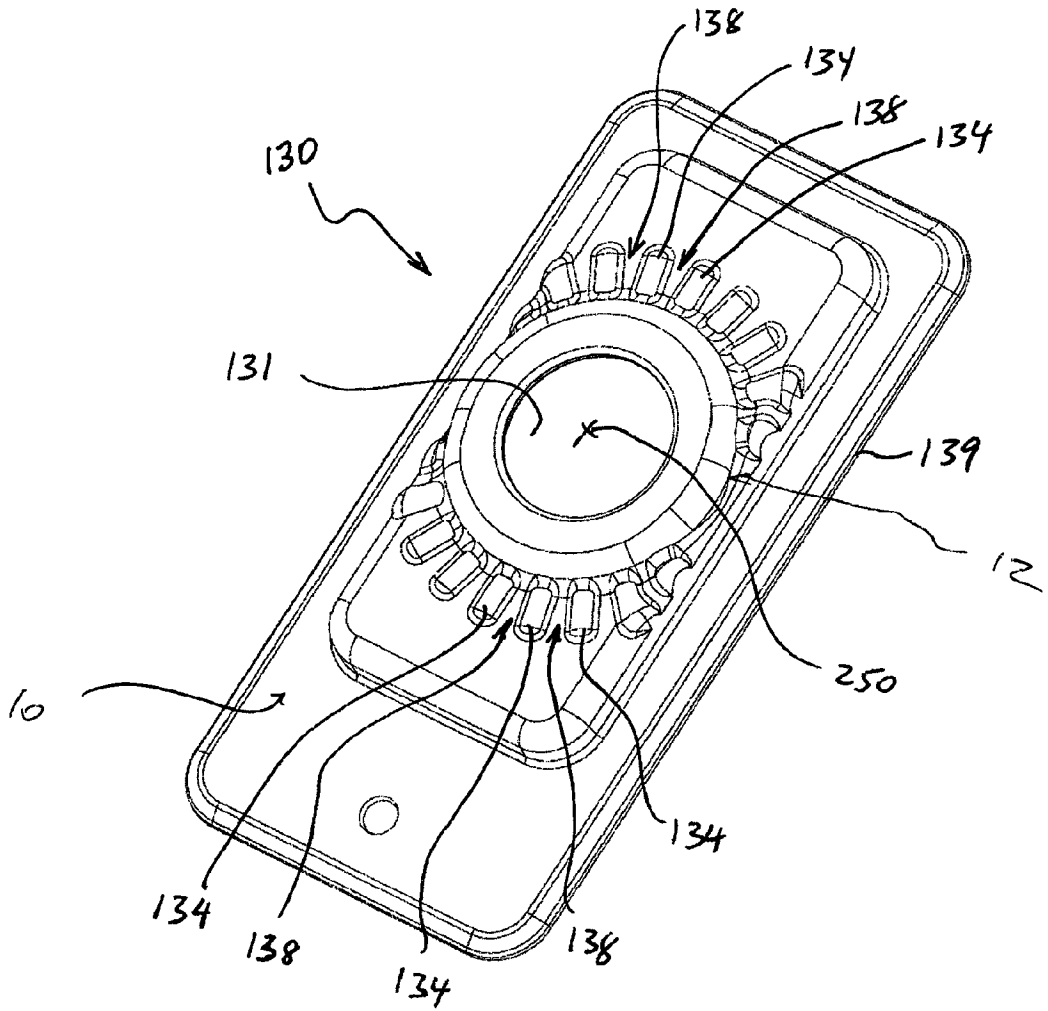
FIG. 7 is a perspective view of one side of the postionable clip effecting integrator of the embodiment illustrated in FIG. 1.
Figure 8:
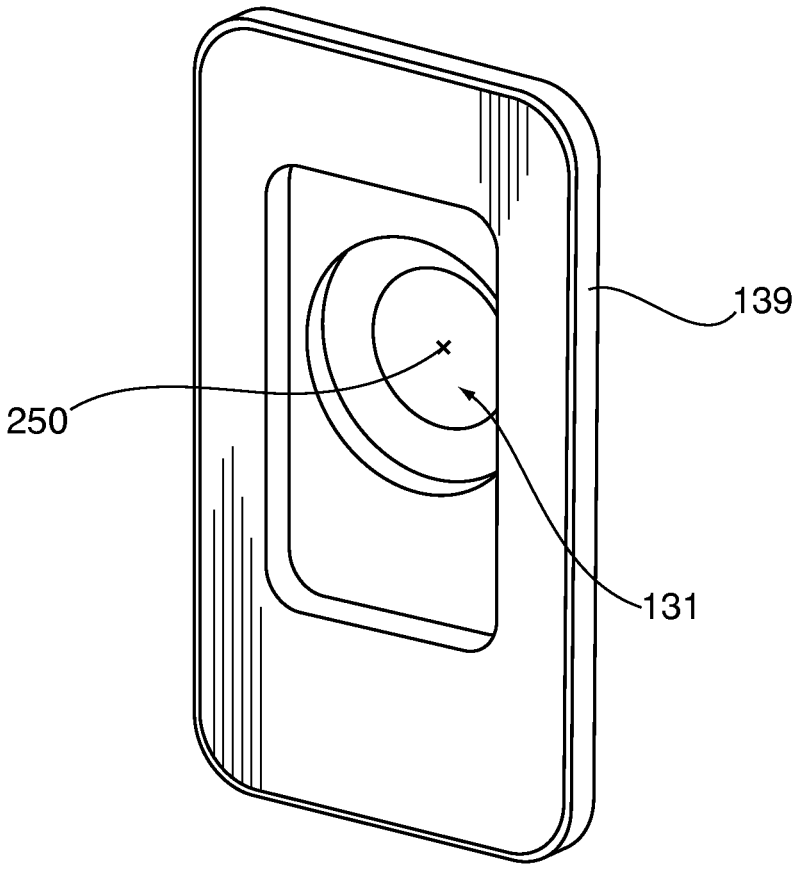
FIG. 8 is a perspective view of another side of the positionable clip effecting integrator illustrated in FIG. 7.
Figure 9:
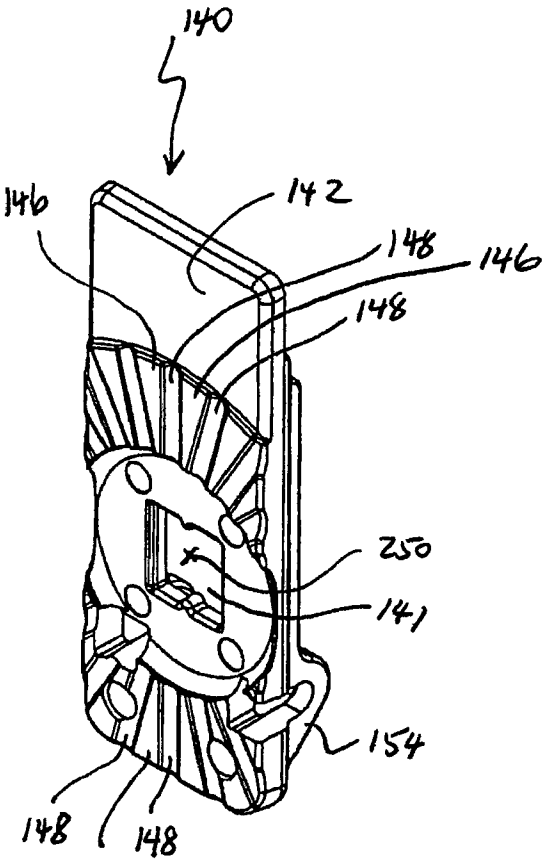
FIG. 9 is a perspective view of one side of the clip mounting structure of the embodiment illustrated in FIG. 1.
Figure 10:
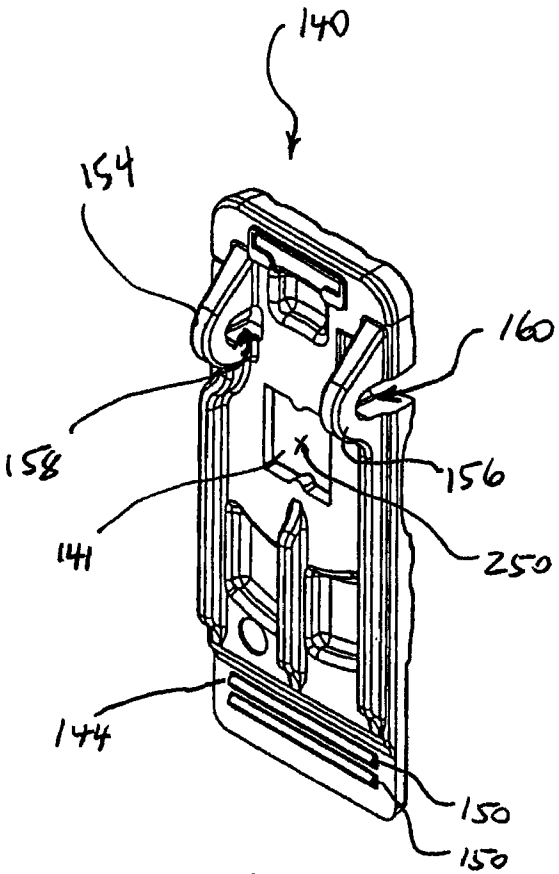
FIG. 10 is a perspective view of another side of the clip mounting structure illustrated in FIG. 9.
Figure 14:
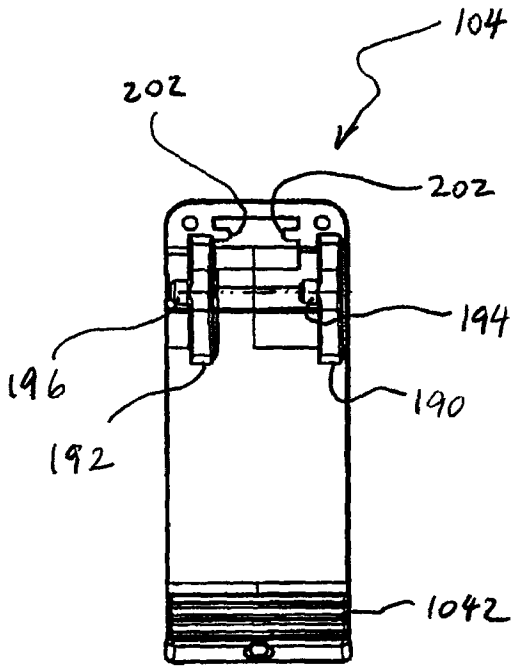
FIG. 14 is a front elevation view of the side of the clip illustrated in FIG. 13.
Figure 16:
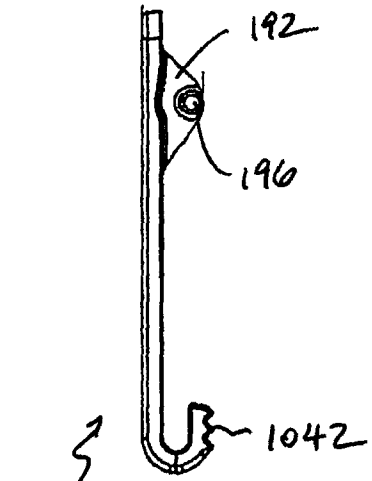
FIG. 16 is a side elevation view of the clip illustrated in FIG. 13.
Figure 18:
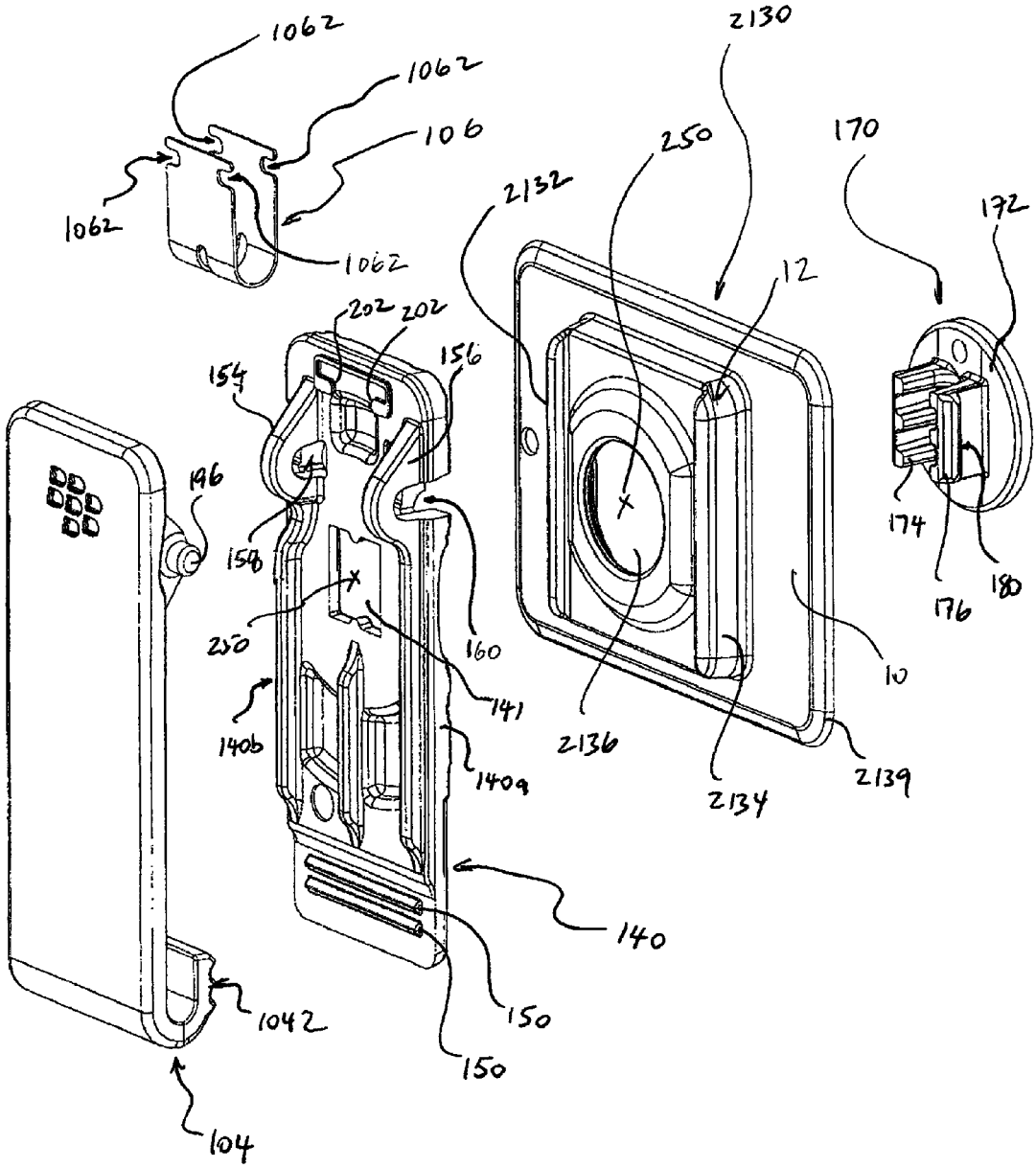
FIG. 18 is an exploded view of the clip, the clip mounting structure, the stationary clip effecting integrator, the retainer, and the leaf spring of a second embodiment of the apparatus.
Figure 21:
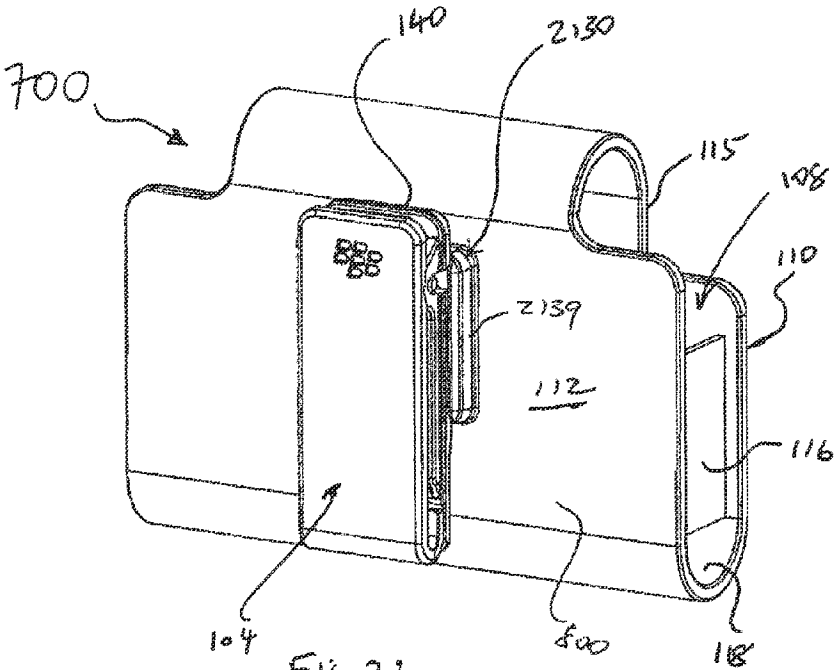
FIG. 21 is a rear perspective view of the second embodiment.

Referring to FIGS. 1 and 21, in some embodiments, the holster 102 includes a device retainer structure 800 and a clip integrator plate 139 or 2139. Each one of the device retainer structure 800 and the clip integrator plate 139 or 2139 contribute to the support of the handheld electronic device 500 received within the pocket 108. Referring to FIGS. 7 and 18, the clip integrator plate 139 or 2139 includes a clip mounting surface 10 and a device retainer attachment surface 12. For example, in some embodiments, the clip mounting surface 10 merges with the device retainer attachment surface 12. The clip mounting surface 10 is coupled to the clip 104. For example, the coupling to the clip 104 is effected through a clip mounting structure 140, as is explained below. The device retainer attachment surface 12 is attached to the device retainer structure 800. For example, the attachment is effected by adhesion, such as by gluing. The clip mounting surface 1392 is raised relative to the device retainer attachment surface 1394.

Figure 6A:
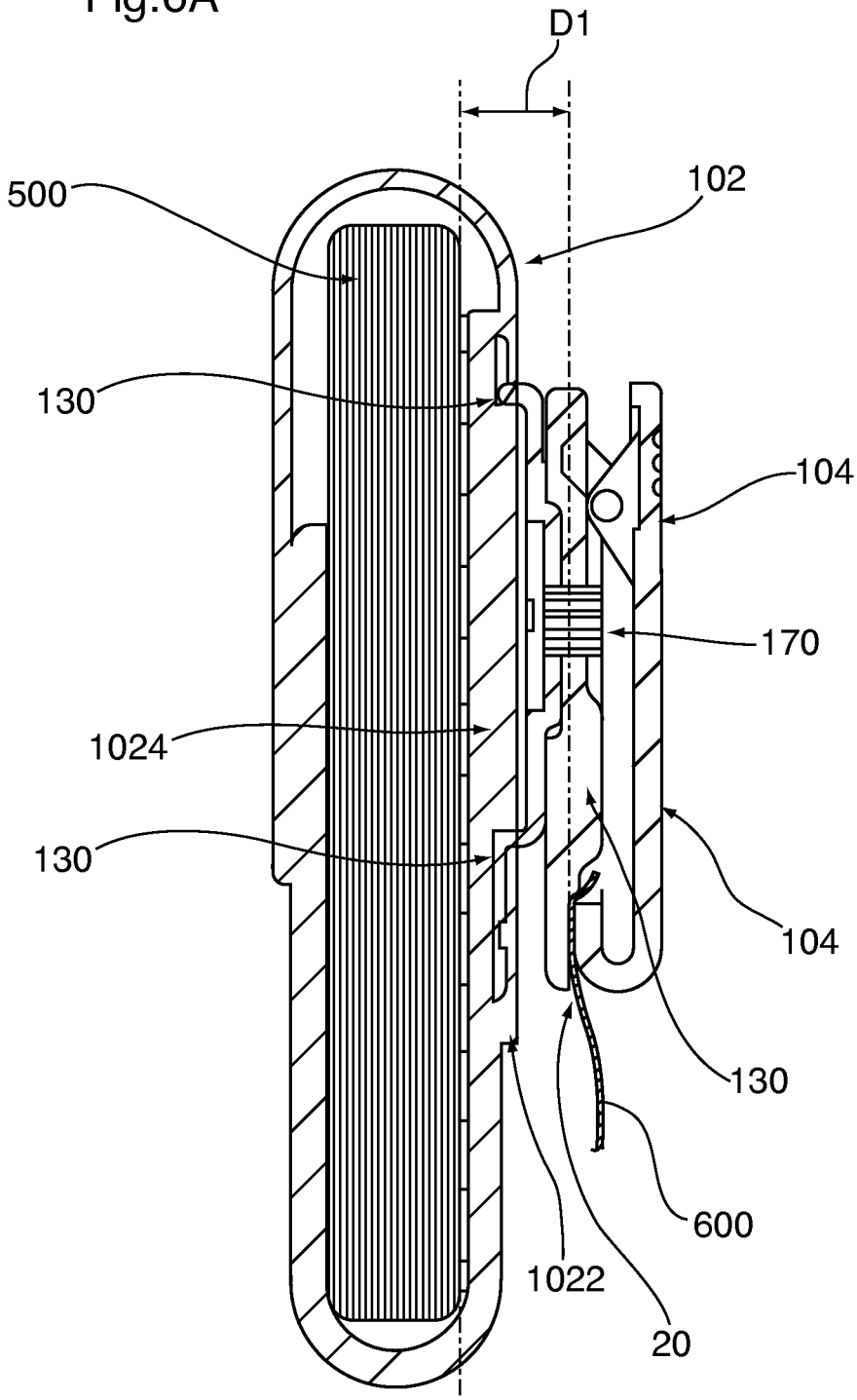
FIG. 6A is a side sectional elevation view of the embodiment illustrated in FIG. 1, coupled to an article of clothing, and shown with a handheld electronic device disposed in the pocket, and illustrating one aspect of the embodiment.

(A) Aspect Relating to Spacing of Handheld Electronic Device Relative to Article of Clothing to which it is Coupled Referring to FIG. 6A, in one aspect, when the coupling of the handheld electronic device 500 to the article 600 is effected, the minimum distance (D1) between the handheld electronic device 500 and each one of the at least one gripping surface portion 20 of the holster 102 is at least eighteen (18) millimeters. For example, in some embodiments, the minimum distance is between eighteen (18) millimeters and twenty-two (22) millimeters. In some embodiments, the minimum distance is provided to minimize the specific absorption rate ("SAR), which is a measure of the rate at which radio frequency energy is absorbed by the body when exposed to a radio frequency electromagnetic field, when the handheld device is coupled near a person's body (such as when the handheld device is coupled, using the apparatus, to an article of clothing worn by a person).

(B) Aspect Relating to Spacing of Interior Support Surface Portions of Holster Relative to Article of Clothing to which Holster is Coupled Referring to FIG. 6A, the holster 102 includes an operative interior holster surface fraction consisting of at least one operative interior holster surface portion 1024. Each one of the at least one operative interior holster surface portion 1024 is configured to oppose and at least contribute support to a handheld electronic device 500 when the handheld electronic device 500 is received and supported within the pocket 108.

When the clip 104 is disposed in the gripping position, each one of the at least one operative interior holster surface portion 1024 is spaced apart from each one of the at least one gripping portion 20 of the holster 102 by a respective minimum distance (D2) of at least eighteen (18) millimetres. For example, in some embodiments, each one of the at least one operative interior holster surface portion is spaced apart from each one of the at least one gripping surface portion 20 by a respective minimum distance of between eighteen (18) millimeters and twenty-two (22) millimetres. In some embodiments, the minimum distance is provided to minimize the specific absorption rate ("SAR), which is a measure of the rate at which radio frequency energy is absorbed by the body when exposed to a radio frequency electromagnetic field, when the handheld device is coupled near a person's body (such as when the handheld device is coupled, using the apparatus, to an article of clothing worn by a person).

In some embodiments, the operative interior holster surface fraction is disposed opposite to the operative exterior holster surface fraction.

In some embodiments, the operative interior holster surface fraction is disposed on an interior surface of the rear wall of the holster.

(C) Embodiments with Selectively Positionable Clip

In some embodiments, the clip 104 is selectively positionable relative to the holster 102. Embodiments whose clip 14 is selectively positionable relative to the holster include those where the holster 104 is configured to support and retain a handheld electronic device 500 in a substantially vertical orientation. In this respect, and referring to FIGS. 3 to 6A, 6B, 7, and 8, in some embodiments, a positionable clip effecting integrator 130 is provided and defines an exterior surface portion 132 of the rear wall portion 112 of the holster 102. The positionable clip effecting integrator 130 co-operates with a clip mounting structure 140 to facilitate selective positioning of the clip mounting structure 140 relative to the holster 102. In this respect, the positionable clip effecting integrator 130 includes an array of ribs 134 of equal or substantially equal size an shape which extend radially outward and define a peripheral boundary centred on the axis 136. Spaced between each one of the ribs 134 is a landing surface 138 such that a plurality of landing surfaces 138 is provided. The ribs 134 and the landing surfaces 138 co-operates with the clip mounting structure 140 so as to effect selective positioning of the clip 104, as will be further explained below. In some embodiments, the positionable clip effecting integrator 130 is in the form of a plate 139 which is integrated within the rear wall portion 112 of the holster 102. For example, in some embodiments, the edges of the plate 139 are chamfered to mitigate against tearing of the device retainer structure 800.

Referring to FIGS. 3 to 6A, 6B, 9, and 10, the clip mounting structure 140 is rotatably coupled to the rear wall portion 112 of the holster 102 so as to effect selective positioning of the clip 104 relative to the holster 102. The clip mounting structure 140 includes a rear wall mounting side surface 142 configured for mounting to the rear wall portion 112, and a clip mounting side surface 144 which is coupled to the clip 104 and is also configured to co-operate with the clip 104 to effect gripping of an article 600 (such as an article of clothing) disposed between the clip 104 and the clip mounting structure 140. In this respect, the clip mounting side surface 144 includes the at least one gripping surface portion 20 of the holster 102. The clip 104 is pivotally coupled to the clip mounting structure 140 to facilitate movement between open, closed, and gripping positions.

A plurality of landing surfaces 146 and a plurality of receiving grooves 148 are defined by the rear wall mounting side surface 142. The landing surfaces 146 are in an array extending radially outward from the axis 122. The receiving grooves 148 are spaced equally between the landing surfaces 146. The receiving grooves 148 and the landing surfaces 146 cooperate with the ribs 134 and the landing surfaces 138 to effect positioning of the clip mounting structure 140 relative to the rear wall portion 112. Selective positioning of the clip 104 relative to the holster 102 is effected by rotation of the clip 102, which is translated to rotation of the clip mounting structure 140, by virtue of the coupling of the clip 104 to the clip mounting structure 140, to one of the predetermined positions defined by the co-operation of the receiving grooves 148 and the landing surfaces 146 of the clip mounting structure 140 with the ribs 134 and the landing surfaces 138 of the positionable clip effecting integrator 130, as will be described in further detail below.

In some embodiments, toe grips 150 extend from the clip mounting side surface 144 to contribute to the gripping of the article of clothing disposed between the clip 102 and the clip mounting structure 140 when the clip 102 is disposed in the gripping position. The toe grips 150 are located proximate to the bottom edge of the clip mounting side surface 144.

In some embodiments, a pair of spaced apart hinge structures 154, 156 extend from the gripping side surface 144. Each one of the hinge structures 154, 156 includes a respective one of receiving apertures 158, 160 which are configured to effect pivotal coupling of the clip 102 to the clip mounting structure 140.

Figure 5:
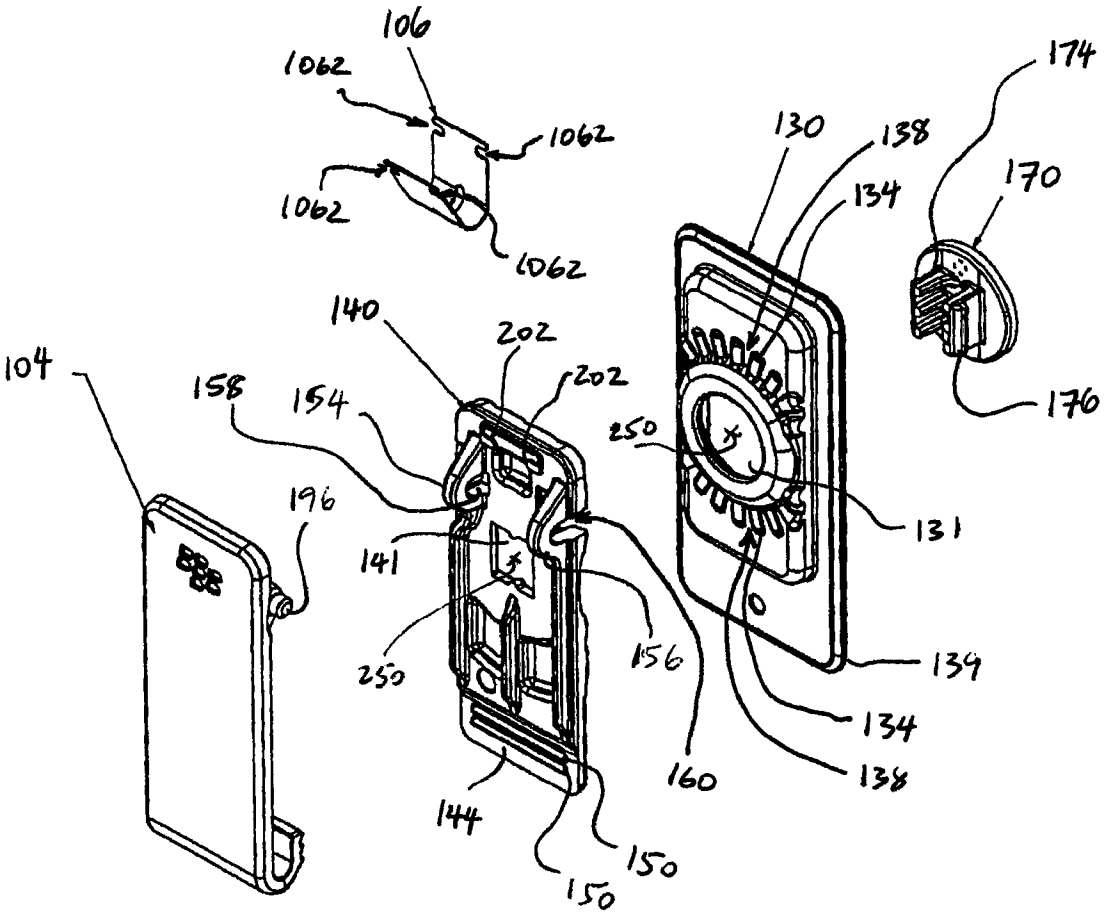
FIG. 5 is an exploded view of the clip, the clip mounting structure, the positionable clip effecting integrator, the retainer, and the leaf spring of the embodiment illustrated in FIG. 1.

Referring to FIGS. 5, 11, and 12, in some embodiments, there is provided a resilient retainer clip (or coupler) 170 which is configured to couple the clip mounting structure 140 to the holster 102 while permitting rotational movement of the clip mounting structure 140 relative to the holster 102 and about an axis 250. The retainer clip 170 is integrated within the rear wall portion 112 of the holster 102. The retainer clip 170 includes a base 172 and a pair of spaced apart retention tabs 174, 176 which extend from the base 172. Each one of the retention tabs 174, 176 includes a respective one of retainer surfaces 178, 180. Each one of the retainer surfaces 178, 180 extend in opposite directions relative to one another. The retainer clip 170 is positioned such that the retentions tabs 174, 176 of the retainer clip 170 extend through apertures 131, 141 provided (each of the apertures 131, 141 is centred on the axis 250) on the positionable clip effecting integrator 130 and the clip mounting structure 140, respectively. The base 172 is oversized relative to the aperture 131 of the integrator 130 such that the base 172 cannot be inserted through the aperture 131. In extending through the aperture 141, the retainer surfaces 178, 180 become disposed in snap-fit engagement with operative surface portions of the clip mounting structure 140 extending from the aperture 141 and co-operate with the edge of the aperture 141 to effect the retention of the clip mounting structure 140 to the holster 102 while permitting rotational movement of the clip mounting structure 140 relative to the holster 102 about the axis 250. In those embodiments where the positionable clip effecting integrator 130 is in the form of a plate 139 integrated within the rear wall portion 112 of the holster, the plate 139 includes a recess 1391 which receives the base 172 and is shaped to facilitate rotation of the base 172 in response to rotational forces applied to the clip 104 which are then translated to the clip mounting structure 140.

Referring to FIGS. 13 to 16, the clip 104 is pivotally coupled to the clip mounting structure 140. The clip 104 includes a pair of spaced apart hinge structures 190, 192. Each one of the hinge structures 190, 192 includes a respective one of the hinge pins 194, 196. Each one of the hinge pins 194, 196 is received in a respective one of the receiving apertures 158, 160 of the clip mounting structure 140, to thereby effect the pivotal coupling of the clip 104 to the clip mounting structure 140. The clip 104 includes a gripping surface 1042 for gripping an article of clothing 600 when the clip 104 is disposed in the gripping position.

Figure 17:
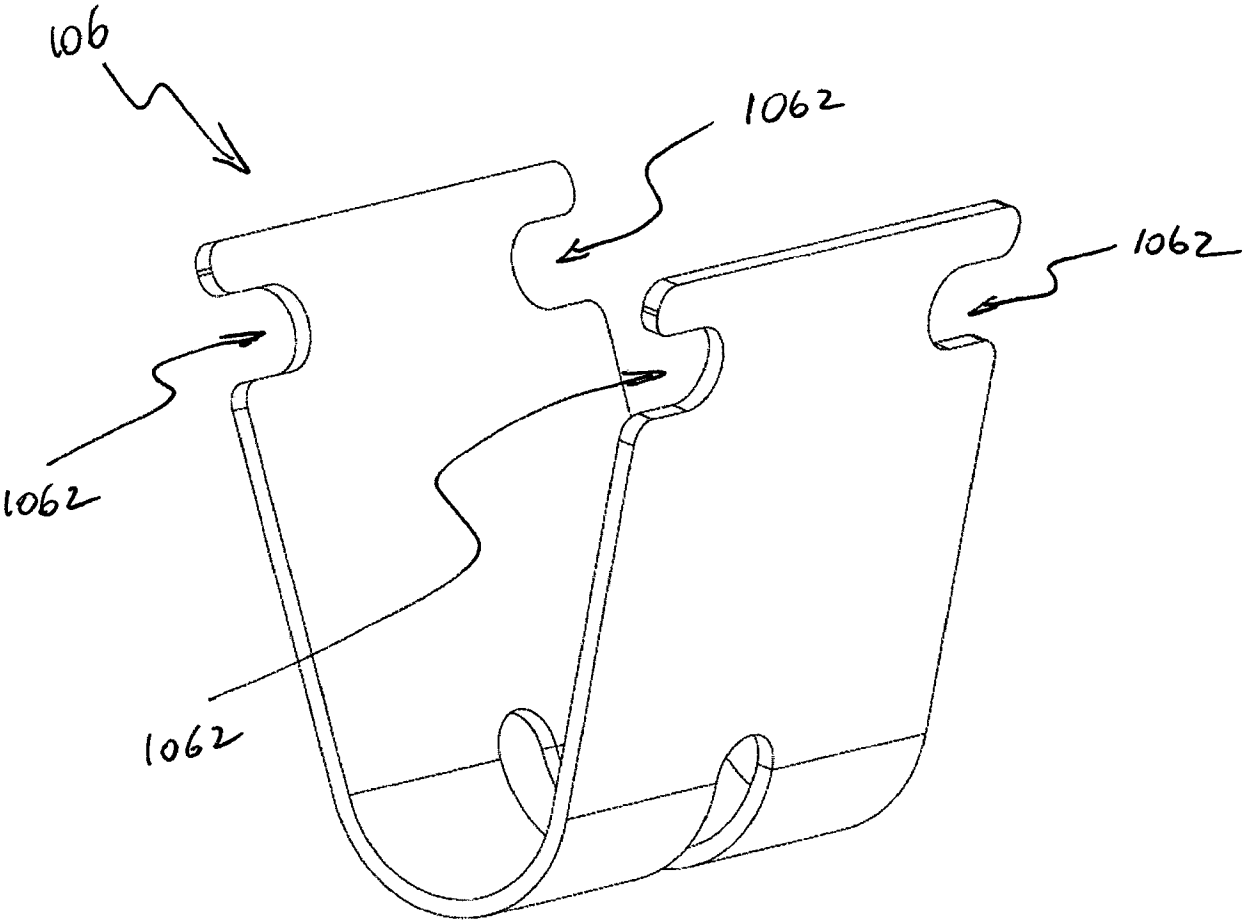
FIG. 17 is a perspective view of the leaf spring of the embodiment illustrated in FIG. 1.

Referring to FIGS. 5 and 17, the clip 104 is biased to the closed position by the biasing member 106. In some embodiments, the biasing member 106 is in the form of a leaf spring 106 which is mounted between the clip 102 and the clip mounting structure 140. For example, the leaf spring 106 is mounted near the pivoting axis defined by the pivotal coupling effected when the hinge pins 194, 196 are received with the receiving apertures 158, 160, respectively. The leaf spring 106 is preferably "C-shaped" so as to urge the gripping end of the clip 102 toward engagement with the toe grips 150 of the clip mounting structure 140, so as to effect gripping of the article of clothing 600. In this way, the clip 104 and the clip mounting structure 140 are mated without applying a holding force during assembly. The clip 104 and the clip mounting structure 140 are formed to include a number of retaining tabs 202, which are received within corresponding interlocking recesses 1062 formed on the leaf spring 106. The leaf spring 106 is of such a width 1064 that once installed, uncoupling of the clip 104 from the clip mounting structure 140 is rendered fairly difficult. The leaf spring 106 serves both a biasing function and an assembly securing feature. The tabs and recesses 202, 1062 co-operate to retain the leaf spring 106 between the clip 104 and the clip mounting structure 140, and mitigate against their uncoupling.

The clip 104 pivots on the hinge pins 194, 196. This allows the user to push down near the top of the clip 104 to raise the other end of the clip 104. Fabric and other materials may then be slid between the raised end of the clip 104 and the clip mounting structure 140. The toe grips 150 and the gripping surface 1062 grip whatever is placed between them as the user discontinues pressure on the clip 104.

The manner of attachment and assembly of the clip 104 relative to the clip mounting structure 140 is also described with respect to corresponding components in commonly owned U.S. Pat. No. 6,073,318 for "Retaining Clip Assembly", issued Jun. 13, 2000 (see column 2, line 32 to column 3, line 6), which is hereby incorporated by reference in its entirety. With the clip 104, the holster 102 can become coupled to an article of clothing worn by a person, while supporting and retaining the handheld device 500. For example, the apparatus 100 can be coupled to a belt or the waistline of clothes.

When the clip mounting structure 140 is mounted to the positionable clip effecting integrator 130, the ribs 134 extend into the grooves 148. Simultaneously, the landing surfaces 138 extend to the landing surfaces 146, thus defining the mounting system and forming a co-operating, interlocking relationship between the clip 104 and the holster 102. This interlocking relationship allows the clip 104 to be releasably held in a desired position relative to the holster 104 by the resilience of the retainer clip 170.

The clip 104 can be swivelled about the axis 250 by the user. The ribs 134 function as detents to the landing surfaces 146. The landing surfaces 146 lift over the corresponding ribs 134 and settle into the next available landing surfaces 138 when the clip 104 is rotated about the axis 250. The user can adjust the orientation of the clip assembly 104 relative to the holster 102 and it will stay in that orientation until the user desires to change it again. That is, the user has the option of adjusting the orientation of the clip assembly 104 relative to the holster 102 by increments equal to the width or spacing of the ribs 134.

Figure 6B:
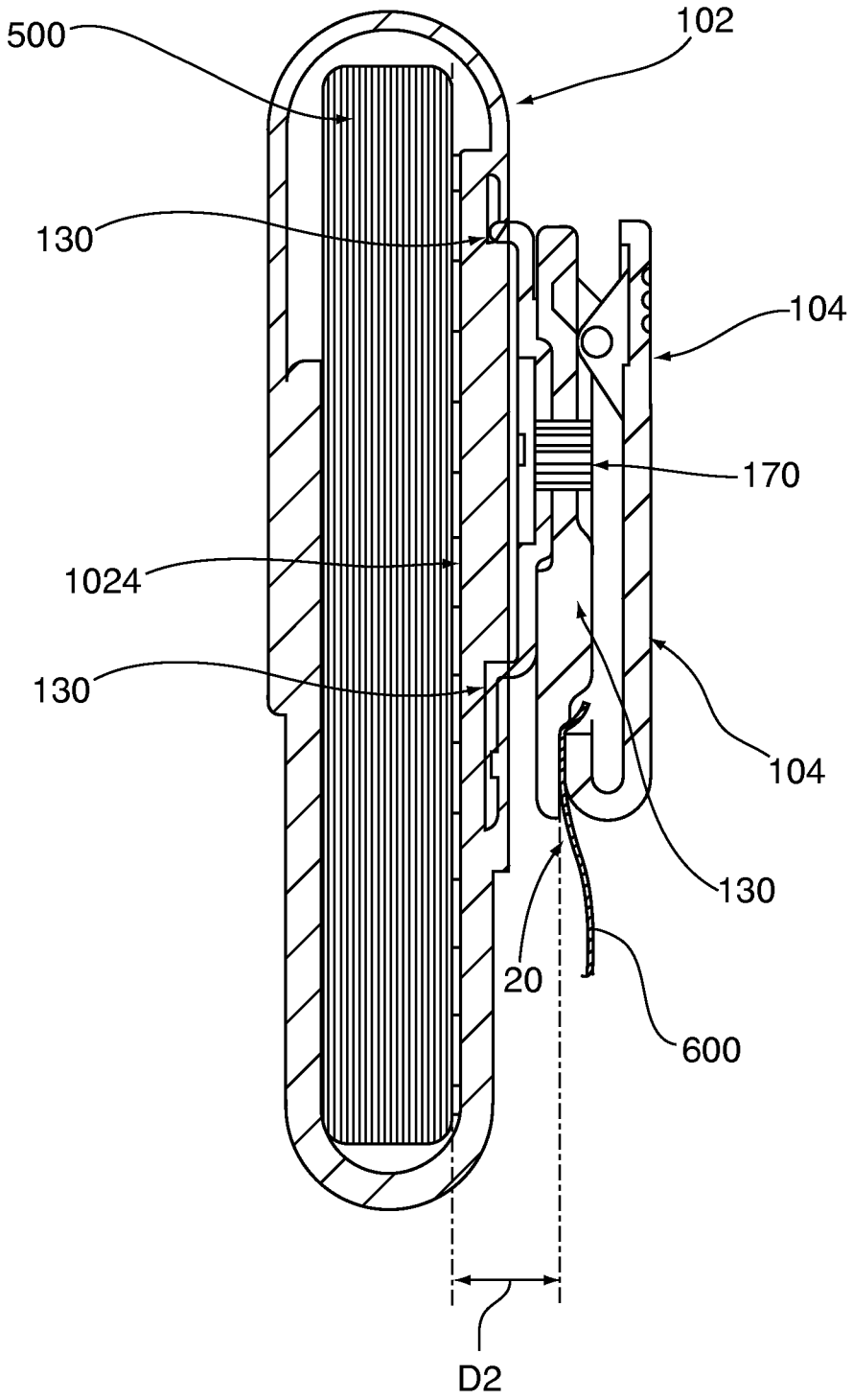
FIG. 6B is a side sectional elevation view of the embodiment illustrated in FIG. 1, coupled to an article of clothing, and shown with a handheld electronic device disposed in the pocket, and illustrating an alternative aspect of the embodiment.

It is understood that each one of the above-described embodiments with the selectively positionable clip incorporates one of the aspects above-described in (A) and (B), which are further illustrated with respect to a selectively positionable clip embodiment in FIG. 6A and 6B.

(D) Embodiments with Stationary Clip

Figure 22:
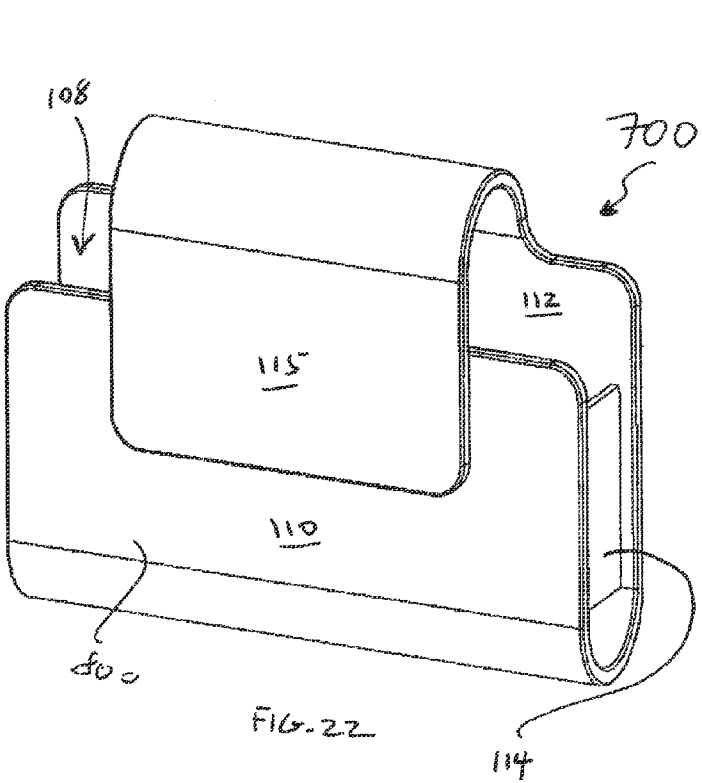
FIG. 22 is a front perspective view of the second embodiment.

In some embodiments, the clip 104 is stationary relative to the holster 102. Referring to FIGS. 21 and 22, embodiments whose clip 104 is stationary relative to the holster 102 include those where the holster 102 is configured to support and retain the handheld electronic device 500 in a substantially horizontal orientation.

Figure 19:
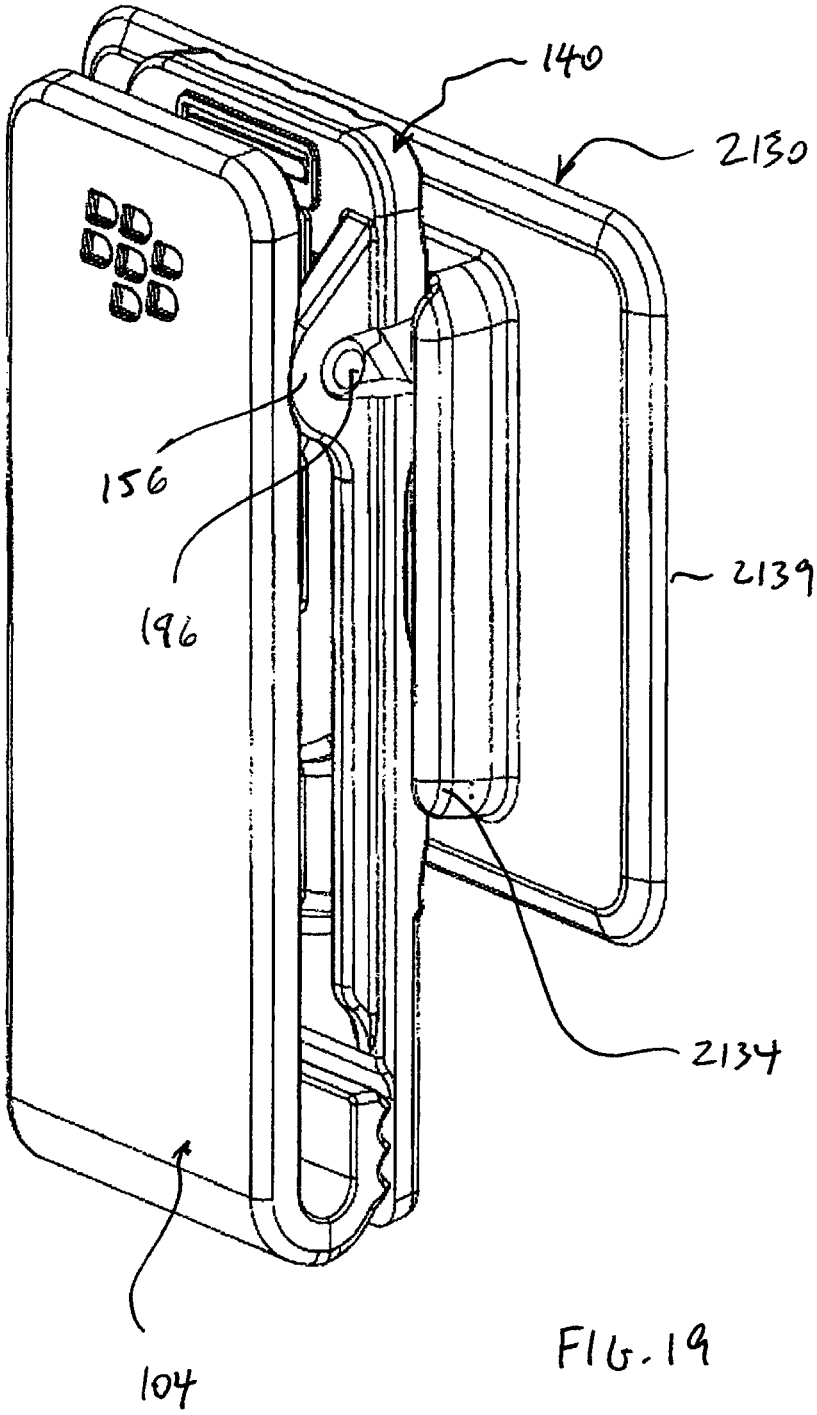
FIG. 19 is a rear perspective view of the clip, the clip mounting structure, and the stationary clip effecting integrator of the second embodiment, in an assembled condition.
Figure 20:
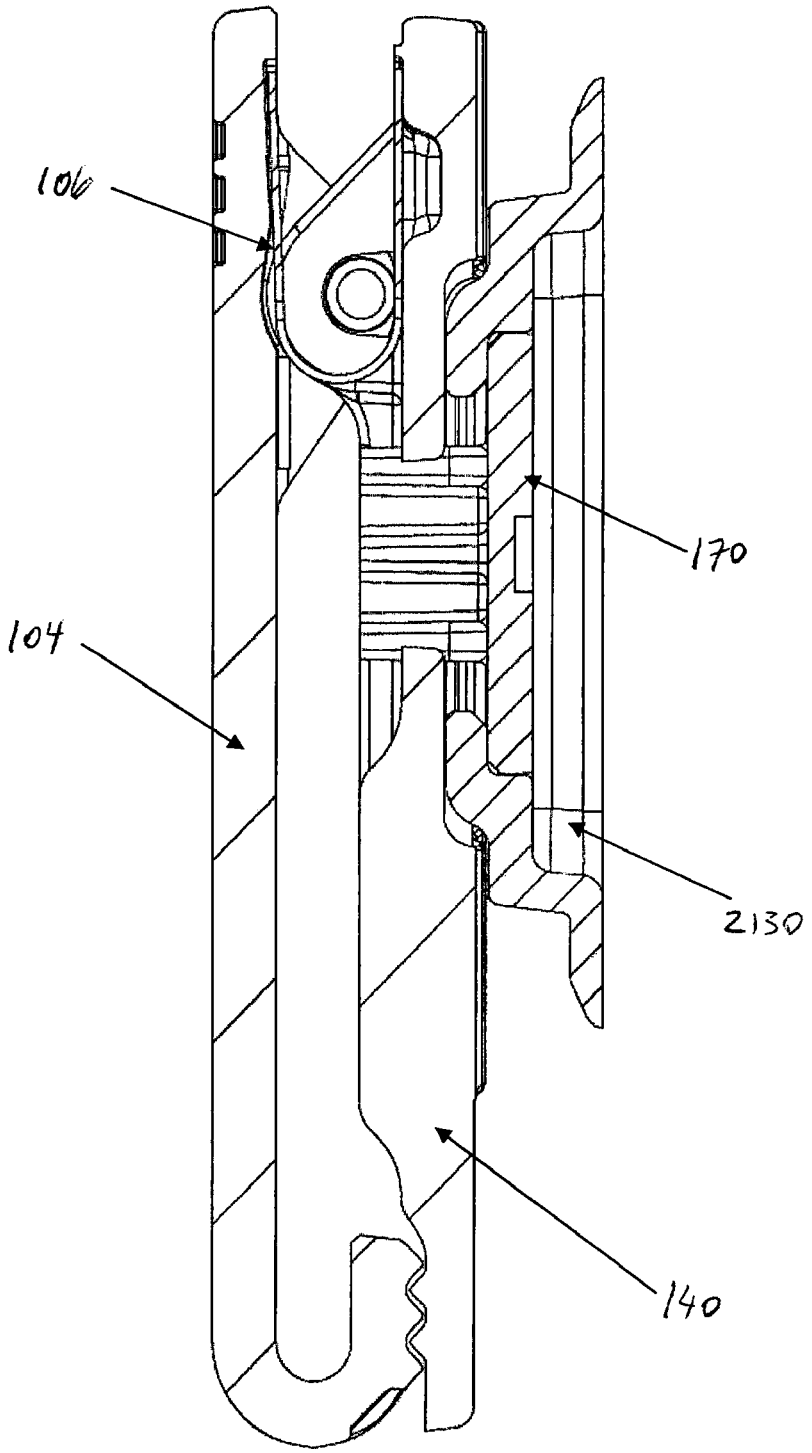
FIG. 20 is a sectional side elevation view of the clip, the clip mounting structure, and the stationary clip effecting integrator of the second embodiment, in an assembled condition.

Referring to FIGS. 18 to 20, embodiments whose clip 104 is stationary relative to the holster 102 can, with the exception of the positionable clip effecting integrator 130, consist of parts which are the same as corresponding parts of embodiments whose clip 104 is positionable relative to the holster 102. Relative to embodiments whose clip 104 is positionable relative to the holster 102, in embodiments whose clip 104 is stationary relative to the holster 102, a stationary clip effecting integrator 2130 replaces the postionable clip effecting integrator 130.

In some embodiments, the stationary clip effecting integrator 2130 is provided and defines an exterior surface portion of the rear wall portion 112 of the holster 102. In some embodiments, the stationary clip effecting integrator 2130 is in the form of a plate 2139 which is integrated within the rear wall portion 112 of the holster 102. For example, in some embodiments, the edges of the plate 2139 are chamfered to mitigate against tearing of the device retainer structure 800.

The stationary clip effecting integrator 2130 includes an aperture 2136 which receives the retainer clip 170. The retainer tabs 174, 176 extend through the aperture 2136 and apply a force which effects coupling of the clip mounting structure 140 to the holster 102 by press-fit engagement of the clip mounting structure 140 to the stationary clip effecting integrator, and, therefore, the holster 112, as described above. The stationary clip effecting integrator 2130 co-operates with the clip mounting structure 140 to facilitate stationary (or substantially stationary) disposition of the clip mounting structure 140 relative to the holster 102. In this respect, the stationary clip effecting integrator 2130 includes a pair of spaced-apart, opposing, parallel (or substantially parallel) ribs 2132, 2134 extending from a surface of the side of the integrator 2130 which is disposed in opposition to the clip mounting structure 140. The ribs 2132, 2134 function as an interference structure which maintains the clip mounting structure 140 in stationary (or substantially stationary) disposition relative to the holster 102 by co-operating with corresponding structures provided on the clip mounting structure 140 to effect interference to rotational movement of the corresponding structures in a plane which is orthogonal to the force which effects the press-fit engagement between the clip mounting structure 140 and the stationary clip effecting integrator 2130. In this respect, in some embodiments, the integrator 2130 is configured such that, each one of the ribs 2132, 2134 is disposed about the periphery and opposes a respective one of opposite side edge portions 140*a*, 140*b* of the clip mounting structure 140. In this respect, the ribs 2132, 2134 function to provide an interference to rotational movement of the clip mounting structure 140 by interfering with rotational movement of the side edge portions 140*a*, 140*b*, respectively.

It is understood that each one of the above-described embodiments with the stationary clip may incorporate one of the aspects above-described in (A) and (B).

(E) Method of Manufacturing Embodiment of Apparatus for Supporting a Handheld Electronic Device There is provided a method of manufacturing any of the above-described embodiments of an apparatus 100 for supporting a handheld electronic device.

The method includes providing a clip 104. Both a stationary clip effecting integrator 2130 and a positionable clip effecting integrator 130 are also provided. When provision of a holster 102 is effected by coupling of the stationary clip effecting integrator 2130 to the holster preform 700 and when the stationary clip effecting integrator 2130 is also coupled to the clip 104, a stationary clip is provided which is disposed in a stationary condition relative to the holster 102, and wherein, when provision of a holster 102 is effected by coupling of the positionable clip effecting integrator 130 to the holster preform 700 and when the positionable clip effecting integrator 130 is also coupled to the clip 104, a positionable clip is provided which is disposed in a positionable condition relative to the holster 102. One of the integrators 130, 2130 is then selected. A holster preform is provided. Formation of the apparatus 100 is effected, wherein the apparatus 100 includes a holster 102 coupled to the clip 104, wherein the holster 102 includes the holster preform 700 and the selected integrator 130 or 2130, wherein the holster preform 700 is coupled to the selected integrator 130 or 2130, and wherein the selected integrator 130 or 2130 is coupled to the clip 104.

In some embodiments, the formation is effected by coupling a clip assembly to the holster preform 700, wherein the clip assembly includes the selected integrator 130 or 2130. For example, the clip assembly also includes the clip 104, the clip mounting structure 140, and the retainer 170.

In some embodiments, the provided holster preform 700 is selected based on the selection of the integrator 130 or 2130. For example, when a positionable clip effecting integrator 130 is selected, a holster preform 700 is selected which is predisposed to effecting formation of a vertically oriented holster, such as that illustrated in FIGS. 1 and 2. As a further example, when a stationary clip effecting integrator 2130 is selected, a holster preform 700 is selected which is predisposed to effecting formation of a horizontally oriented holster, such as that illustrated in FIGS. 21 and 22.

In some embodiments, the forming of the apparatus 100 includes coupling the selected integrator 130 or 2130 to the clip 104 to effect formation of a predetermined clip configuration, and then coupling the predetermined clip configuration to the holster preform 700.

In some embodiments, the forming of the apparatus 100 includes coupling the selected integrator 130 or 2130 to the holster preform 700 to effect formation of the holster 102, and then coupling the clip 104 to the holster 102.

In some embodiments, the method of manufacturing the apparatus 100 includes the following:

(a) providing a stationary clip effecting integrator 2130 and a positionable clip effecting integrator 130 (for example, each one of the integrators is made from CYCOLOY C1200 HF™ manufactured by SABIC Innovative Plastics)

(b) selecting one of the stationary clip effecting integrator 2130 and the positionable clip effecting integrator 130;

(c) cutting material (e.g. leather) to the desired shape of the holster 102, and providing a cut-out in the material to facilitate incorporation of a selected integrator;

(d) gluing stiffener structure (such as plastic material) to the inside surface of the material to effect stiffening of the material and thereby provide a composite material (e.g. thickness is about three (3) millimetres);

(e) positioning the selected integrator 130 or 2130 into the cut-out in the composite material;

(f) positioning the retainer clip 170 (for example, the retainer clip 170 is made from NORYL NWR5810™ manufactured by SABIC Innovative Plastics) for insertion through the aperture 131 provided in the selected integrator 130 or 2130;

(g) mounting the clip 104 (for example, the clip 104 is made from NORYL NWR5810™ manufactured by SABIC Innovative Plastics) onto the clip mounting structure 140 (for example, the clip mounting structure 140 is made from NORYL NWR5810™ manufactured by SABIC Innovative Plastics) by inserting the hinge pins 194, 196 of the clip 104 into the corresponding apertures 158, 160 provided on the hinge structures 154, 156, respectively, of the clip mounting structure 140;

(h) integrating the leaf spring 106 between the clip 104 and the clip mounting structure 140 by positioning the tabs 202 in the corresponding recesses 1062 to effect interlocking between the leaf spring 106 and each of the clip 104 and the clip mounting structure 140, and thereby provide a clip assembly;

(i) positioning the clip assembly over the selected integrator such that the retainer 170 is received through the aperture 141 provided in the clip mounting structure 140 and engages the clip mounting structure 140 in snap-fit engagement, as described above;

(j) gluing further internal padding structure (e.g. cardboard and/or foam, having a thickness of about three (3) millimetres) over the leather composite and the selected integrator;

(k) applying liner (e.g. felt, 0.5 millimetres thick) over the internal structure and stitching the liner to the composite material; and (l) stitching side wall portions to the rear wall portion.

It will be appreciated that the above description relates to the preferred embodiments by way of example only. Many variations will be obvious to those knowledgeable in the field, and such variations are within the scope as described and claimed.

We claim:

1. An apparatus for supporting a handheld electronic device, comprising:

a holster including a pocket for receiving the handheld electronic device and supporting the received handheld electronic device; and a clip coupled to the holster and configured for movement between an open position and a gripping position and being biased towards the gripping position, wherein, in the open position, spacing is provided between the clip and the holster so as to receive an article, and wherein, in the gripping position, the clip is disposed such that, when an article is disposed between the clip and the holster, the article is gripped by the clip against at least one gripping surface portion of the holster under the force effecting biasing of the clip towards the gripping position, and such that, when the clip is disposed in the gripping position, and the handheld electronic device is received and supported by the pocket, coupling of the handheld electronic device to the article is thereby effected;

and wherein, when the coupling of the handheld electronic device to the article is effected, the minimum distance between the handheld electronic device and each one of the at least one gripping surface portion of the holster is at least eighteen (18) millimeters.

2. The apparatus as claimed in claim 1, wherein, prior to the article being gripped, the article has been previously received within the spacing provided when the clip is disposed in the open position.

3. The apparatus as claimed in claim 1, wherein, prior to the article being gripped, the article has been previously received within the spacing provided when the clip is disposed in the open position, and the clip is urged into the gripping position by the force being applied by the biasing member.

4. The apparatus as claimed in claim 1, wherein the biasing of the clip towards the gripping position is effected by a biasing member.

5. The apparatus as claimed in claim 4, wherein the biasing member is a resilient member.

6. The apparatus as claimed in claim 5, wherein the resilient member is a leaf spring.

7. The apparatus as claimed in claim 1, wherein the coupling of the clip to the holster is a pivotal coupling.

8. An apparatus for supporting a handheld electronic device, comprising:

a holster including a pocket for receiving the handheld electronic device and supporting the received handheld electronic device; and a clip coupled to the holster and configured for movement between an open position and a gripping position and being biased towards the gripping position, wherein, in the open position, spacing is provided between the clip and the holster so as to receive an article, and wherein, in the gripping position, the clip is disposed such that, when an article is disposed between the clip and the holster, the article is gripped by the clip against at least one gripping surface portion of the holster under the force effecting biasing of the clip towards the gripping position, and such that, when the clip is disposed in the gripping position, and the handheld electronic device is received and supported by the pocket, coupling of the handheld electronic device to the article is thereby effected, wherein the holster includes an operative interior holster surface fraction consisting of at least one operative interior holster surface portion which is configured to oppose and at least contribute support to the handheld electronic device when the handheld electronic device is received and supported within the pocket;

and wherein, when the clip member is disposed in the gripping position, each one of the at least one operative interior holster surface portion is spaced apart from each one of the at least one gripping surface portion of the holster by a respective minimum distance of at least eighteen (18) millimeters.

9. The apparatus as claimed in claim 8, wherein the operative interior holster surface fraction is disposed opposite to the at least one gripping surface portion.

10. The apparatus as claimed in claim 8, wherein the pocket is defined, at least in part, by a rear wall, and the operative interior holster surface fraction is disposed on the interior surface of the rear wall.

11. The apparatus as claimed in claim 8, wherein the biasing of the clip towards the gripping position is effected by a biasing member.

12. The apparatus as claimed in claim 11, wherein the biasing member is a resilient member.

13. The apparatus as claimed in claim 12, wherein the resilient member is a leaf spring.

14. The apparatus as claimed in claim 8, wherein the coupling of the clip to the holster is a pivotal coupling.

15. A method of manufacturing an apparatus for supporting a handheld electronic device, comprising:

providing a holster preform;

providing a clip;

providing a stationary clip effecting integrator and a positionable clip effecting integrator, wherein, when provision of a holster is effected by coupling of the stationary clip effecting integrator to the holster preform and when the stationary clip effecting integrator is also coupled to the clip, a stationary clip is provided which is disposed in a stationary condition relative to the holster, and wherein, when provision of the holster is effected by coupling of the positionable clip effecting integrator to the holster preform and when the positionable clip effecting integrator is also coupled to the clip, a positionable clip is provided which is disposed in a positionable condition relative to the holster;

selecting one of the stationary and positionable clip effecting integrators;

effecting formation of the apparatus, wherein the apparatus includes the holster coupled to the clip, wherein the holster includes the holster preform and the selected integrator, wherein the holster preform is coupled to the selected integrator, and wherein the selected integrator is coupled to the clip.

16. The method as claimed in claim 15, wherein the forming of the apparatus includes:

coupling the selected integrator to the clip to effect formation of a predetermined clip configuration; and coupling the predetermined clip configuration to the holster preform.

17. The method as claimed in claim 15, wherein the forming of the apparatus includes;

coupling the selected integrator to the holster preform to effect formation of the holster; and coupling the clip to the holster.

18. The method as claimed in claim 15, wherein the forming is effected by coupling a clip assembly to the holster preform, wherein the clip assembly includes the selected integrator.

19. The method as claimed in claim 15, wherein the provided holster preform is selected based on the selection of the integrator.

20. An apparatus for supporting a handheld electronic device, comprising:

a holster including a pocket for receiving the handheld electronic device and supporting the received handheld electronic device, and including:

a stationary clip effecting integrator; and a clip mounting structure coupled to the stationary clip effecting integrator by a force effecting press-fit engagement of the clip mounting structure to the stationary clip effecting integrator;

a clip coupled to the clip mounting structure and configured for movement between an open position and a gripping position and being biased towards the gripping position, wherein, in the open position, spacing is provided between the clip and the holster so as to receive an article, and wherein, in the gripping position, the clip is disposed such that, when an article is disposed between the clip and the holster, the article is gripped by the clip against at least one gripping surface portion of the holster under the force effecting biasing of the clip towards the gripping position, and such that, when the clip is disposed in the gripping position, and the handheld electronic device is received and supported by the pocket, coupling of the handheld electronic device to the article is thereby effected;

and wherein the stationary clip effecting integrator includes spaced-apart opposing ribs extending from the stationary clip effecting integrator in opposition to side edge portions of the clip mounting structure, the spaced-apart opposing ribs arranged to interfere with movement of the clip mounting structure at the side edge portions in response to a force applied to the clip mounting structure for urging rotation of the clip mounting structure in a plane which is orthogonal to the direction of the force which is effecting the press-fit engagement of the clip mounting structure to the stationary clip effecting integrator.

* * * * *